United States Patent [19]

Katoh

[11] Patent Number: 4,794,837

[45] Date of Patent: Jan. 3, 1989

[54] TONE SIGNAL GENERATOR WITH CODE CONVERTER FOR CONVERTING STORED WAVESHAPES OF DIFFERENT CODING FORMS INTO A COMMON CODING FORM

[75] Inventor: Mitsumi Katoh, Hamamatsu, Japan

[73] Assignee: Nippon Gakki Seizo Kabushiki Kaisha, Hamamatsu, Japan

[21] Appl. No.: 787,651

[22] Filed: Oct. 16, 1985

[30] Foreign Application Priority Data

Oct. 17, 1984 [JP] Japan ..... 59-216088
Nov. 6, 1984 [JP] Japan ..... 59-232299

[51] Int. Cl.[4] ..... G10H 1/06; G10H 1/46; G10H 7/00

[52] U.S. Cl. ..... 84/1.01; 84/1.1; 84/1.19; 84/1.27

[58] Field of Search ..... 84/1.19, 1.27, 1.01, 84/1.03, 1.1

[56] References Cited

U.S. PATENT DOCUMENTS 4,611,522 9/1986 Hideo ..... 84/1.01
4,618,851 10/1966 Watanabe ..... 84/1.27

*Primary Examiner*—S. J. Witkowski

*Attorney, Agent, or Firm*—Spensley Horn Jubas & Lubitz

[57] ABSTRACT

A plurality of waveshapes of different characteristics are stored in a waveshape memory among which a waveshape to be read out is selected in accordance with a selected tone color or elapse of time and data of the selected waveshape is read out. At least one waveshape among the waveshapes stored in the waveshape memory is coded in a coding form different from one used for the other waveshapes. For matching characteristics of each individual waveshape, waveshapes are coded according to respectively suitable coding forms such, for example, that one waveshape is coded according to the pulse code modulation system, another waveshape according to the differential pulse code modulation system and still another waveshape according to the delta modulation system. The waveshape data read out from the waveshape memory is converted in its code to a predetermined common coding form (e.g. PCM). By differring the coding form of waveshapes stored in the waveshape memory, reduction in the memory capacity and improved resolution in reproduced waveshapes matching characteristics of individual waveshapes can be achieved.

18 Claims, 5 Drawing Sheets

CODE CONVERSION CKT 6

CODE CONVERSION CKT 6

TONE SIGNAL GENERATOR WITH CODE CONVERTER FOR CONVERTING STORED WAVESHAPES OF DIFFERENT CODING FORMS INTO A COMMON CODING FORM

BACKGROUND OF THE INVENTION

This invention relates to a tone signal generation device of a waveshape memory reading type and, more particularly, to a tone signal generation device in which a waveshape is selectively read out from among a plurality of different waveshapes stored in a waveshape memory. The invention further relates to a tone signal generation device in which a waveshape memory stores plural waveshapes corresponding to partial time sections in an entire tone generation duration from the start of sounding of a tone to the end thereof.

U.S. Pat. No. 4,383,462 discloses an electronic musical instrument in which an entire waveshape from the start of sounding of a tone to the end thereof or partial waveshapes of plural periods are stored in a waveshape memory and a tone signal of a high quality closely resembling a tone of a natural musical instrument is produced by accessing this waveshape memory. For enabling selection of several kinds of tone colors in such electronic musical instrument, waveshapes corresponding to the respective tone colors (an entire waveshape or partial waveshapes of plural periods) must be respectively stored in a waveshape memory. Besides, for affording variety to the tone color depending upon a key touch or a tone pitch of a tone to be generated, waveshapes corresponding to several levels of the key touch strength or waveshapes corresponding to several tone pitches or tone ranges must be respectively stored in the waveshape memory.

In storing different entire waveshapes of several kinds in a waveshape memory, the prior art device employs a common coding form without considering individual characteristics of original waveshapes. This results in undue increase in the memory capacity or, if the memory capacity is held below a certain limit, resolution of sampled waveshape is deteriorated. If, for example, such a coding form is adopted as a pulse code modulation system (hereinafter called "PCM system") which is capable of reproducing with a high resolution a waveshape changing in a complicated manner, a large memory capacity is required and this large memory capacity is wasted when the stored waveshape is a relatively simple waveshape which does not require a high resolution and, accordingly, the memory capacity increases more than necessary as a whole. If, conversely, saving of the memory capacity is intended by adopting such a coding form as a differential pulse code modulation system (hereinafter called "DPCM" system) suitable for saving the memory capacity, resolution of the reproduced waveshape is deteriorated with respect to a waveshape which undergoes a complicated change, though this construction will be suitable for a waveshape of a relatively simple change.

Also in storing a series of partial waveshapes of plural periods in a waveshape memory, the coding form of waveshape data to be stored in the waveshape memory has conventionally been the same for all partial waveshapes and the PCM system, is generally employed. The PCM system is suitable for accurately reproducing a waveshape changing timewise in a complicate manner with a high resolution but requires a relatively large number of bits for waveshape data of one sample point with a result that the memory capacity tends to become large. This tendency is strong particularly when waveshapes of plural periods are stored as described above, resulting in provision of a waveshape memory of a very large memory capacity. On the other hand, the employment of a coding form (e.g. the DPCM system) capable of saving the memory capacity causes the problem that the accuracy in reproduction of a waveshape is sacrificed in a portion in which the waveshape changes in a relatively complicate manner.

SUMMARY OF THE INVENTION

It is, therefore, an object of the present invention to provide a tone signal generation device which has overcome the above described problem.

It is a more specific object of the invention to provide a device generating a tone signal of a high quality by storing in a waveshape memory plural entire waveshapes or plural partial waveshapes which are coded by different coding forms.

Waveshapes corresponding to different tone colors include complicated waveshapes rich in variety as well as simple ones. For these waveshapes of different characteristics, their should be different coding forms which are respectively suitable for these different characteristics and one coding form should not be considered suitable for all waveshapes. In view of this, it is a feature of the invention to code each waveshape in a coding form suitable for its individual waveshape characteristics for storing this coded waveshape in a waveshape memory.

According to one aspect of the present invention, a tone signal generation device is characterized in that at least one waveshape among different waveshapes stored in a waveshape memory is coded according to a coding form which is different from one used for other waveshapes. A waveshape of a tone to be generated is selected from among waveshapes stored in this waveshape memory through different coding forms and the selected waveshape is read out from the waveshape memory and is appropriately decoded. There may be provided code conversion means for converting the read out waveshape data to data of a predetermined certain coding form to simplify the decoding operation.

In the DPCM system, for example, a difference value between amplitudes of adjacent sample points has only to be stored as waveshape data of respective sample points so that the memory capacity can be generally reduced as compared with the PCM system. Accordingly, the memory capacity as a whole can be reduced as compared with a case where the PCM system only is employed.

A tone signal generation device according to another aspect of the invention is characterized in that plural partial waveshapes corresponding to plural time sections in an entire sounding duration from the start of sounding of a tone to the end thereof are stored and at least one of these waveshapes is coded according to a coding form which is different from one used for the other waveshapes. There is provided reading means for timewise switching a waveshape to be read out and reading out a waveshape determined by this switching from a waveshape memory.

It is known that tone waveshapes of the same tone color have different waveshape characteristics depending upon their timewise stages such as their rise, sustain and decay portions. Generally speaking, the waveshape of the rise portion changes in a complicated manner and the waveshape of the sustain portion is relatively stable, without undergoing much change. Since waveshape characteristics differ depending upon the timewise stages of sounding of the tone, a waveshape memory can be utilized efficiently if these waveshape portions are coded according to a coding form suited to the respective waveshape characteristics. More specifically, the effective utilization of the memory can be realized if different coding forms are mixedly used such that, for example, a waveshape portion such as the rise portion which changes in a complicated manner is coded by employing the PCM system which has sharp response characteristics to the change and high accuracy in reproduction of the waveshape whereas a waveshape portion such as the sustain portion which is relatively stable is coded by employing the DPCM system which is capable of reducing the number of data bit. If the data bit number for one sample point is made different depending upon the coding form adopted, reduction of the memory capacity is realized in the portion in which a coding form requiring less data bit number is employed whereas a tone signal of a high quality can be produced without impairing the quality of the tone by employing a coding form suitable for realizing a high-accuracy reproduction of the waveshape in a portion in which such high-accuracy reproduction is required. Instead of reducing the memory capacity, data for one sample point may be reproduced with a sufficient bit number in a portion in which a coding form capable of reducing the data bit number is employed. This increases the number of efficient bits so that accuracy in reproduction of the waveshape is further improved.

Selection of a waveshape read out from among the stored different waveshapes is advantageously carried out through various means such as a tone color selector, a key touch response control system and/or a tone color control system by tone pitch or tone range of a depressed key.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
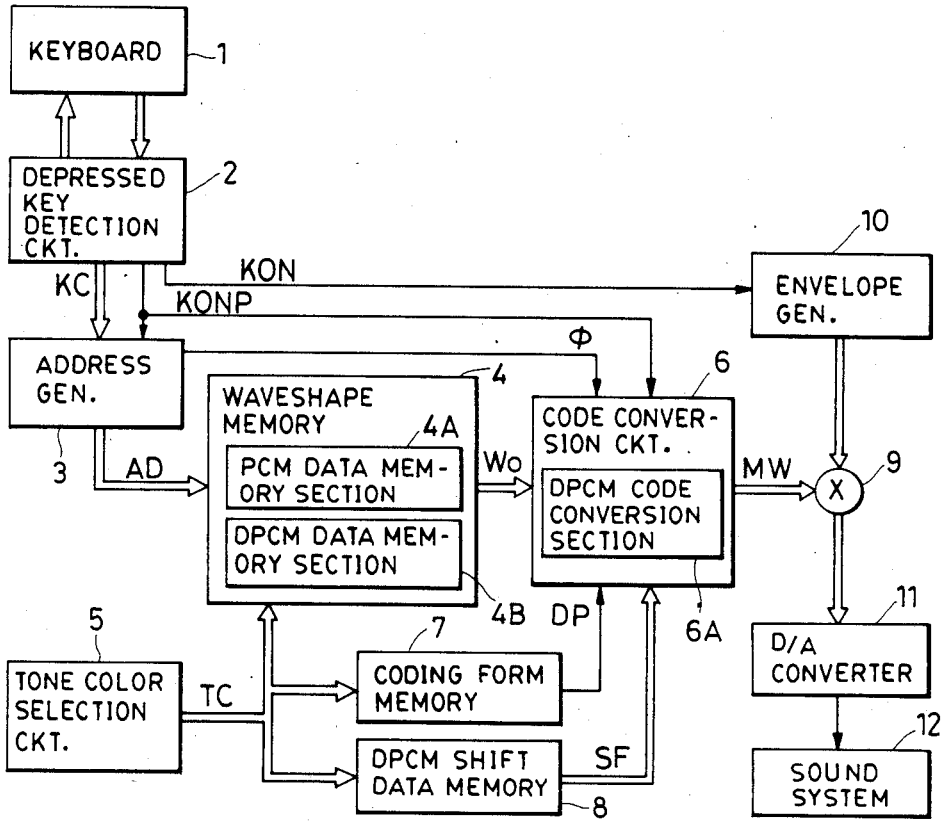
FIG. 1 is a block diagram showing an entire construction of an embodiment of a tone signal generation device according to the invention.

FIG. 1 shows an embodiment of the invention applied to a keyboard type electronic musical instrument. A keyboard 1 has playing keys for designating tone pitches of tones to be produced. A depressed key detection circuit 2 detects a depressed key in the keyboard 1 and thereupon produces a key code KC corresponding to the depressed key, a key-on signal KON holding a signal "1" while the depression of the key is sustained and a key-on pulse KONP which becomes a signal "1" momentarily upon start of depression of the key. For convenience of explanation, it is assumed that the electronic musical instrument of this embodiment is a monophonic one and the depressed key detection circuit 2 has a monophonic selection function. It is of course possible to apply this invention to a polyphonic electronic musical instrument by employing a known key assigner.

An address generator 3 generates, responsive to the key code KC supplied from the depressed key detection circuit 2, an address signal AD which changes at a rate corresponding to the tone pitch of the depressed key. This address signal AD is applied to a sample point address input of a waveshape memory 4 in which it is used for sequentially reading waveshape data at respective sample points.

The waveshape memory 4 stores different waveshapes corresponding to tone colors which are selectable by a tone color selection circuit 5. At least one of the waveshapes stored in the waveshape memory 4 is coded according to a coding form which is different from one used for other waveshapes. In this embodiment, respective waveshapes are coded according to either the PCM system or the DPCM system. The waveshape memory 4 comprises a PCM data memory section 4A storing waveshape data of a waveshape coded according to the PCM system and a DPCM data memory section 4B storing waveshape data of a waveshape coded according to the DPCM system. A tone color of a harpsichord, for example, undergoes a sharp waveshape change in the rise portion of the tone and such tone color should preferably be coded according to the PCM system. On the other hand, a tone color of a flute, for example, undergoes little waveshape change in its rise portion and it should preferably be coded according to the DPCM system.

Tone color selection information TC representing the selected tone color is applied to a waveshape address input of the waveshape memory 4 in which this information TC designates a waveshape corresponding to the selected tone color as a waveshape to be read out. Waveshape data $W_0$ at each sample point of the designated waveshape is sequentially and successively read out from the waveshape memory 4 in response to the address signal AD.

The read out waveshape data $W_0$ is applied to a code conversion circuit 6 in which it is converted to a predetermined common coding form in accordance with the coding form thereof. In this embodiment the PCM system is selected as the predetermined common coding form. No code conversion therefore is made in the code conversion circuit 6 as to waveshape data which has originally been coded according to the PCM system whereas waveshape data which has originally been coded according to the DPCM system is converted to data of the PCM system. For converting data of the DPCM system to data of the PCMs system, the code conversion circuit 6 includes a DPCM code conversion section 6A.

A coding form memory 7 stores data indicating the coding form in which waveshapes corresponding to the respective tone colors are stored in the waveshape memory 4. This memory 7 receives the tone color selection information TC at its address input and outputs data indicating the coding form relating to the tone color indicated by the tone color selection information TC. Since in the present embodiment the two coding forms of the PCM and DPCM systems are employed, coding form indication data DP read out from the memory 7 indicates either of these two coding forms. For example, when the data DP is "1", it indicates the DPCM system and when it is "0", it indicates the PCM system. This data DP is applied to the code conversion circuit 6 to designate contents of the code conversion operation in the circuit 6. That is, when the data DP is "0", no particular code conversion operation is made but waveshape data of the PCM system is directly provided whereas when the data DP is "1", it designates the code conversion operation so that the waveshape data of the DPCM system will be converted to data of the PCM system.

In this embodiment, an arrangement is made so that weighting of data of each bit can be varied between respective waveshapes notwithstanding that waveshape data of these waveshapes are coded according to the same DPCM system. If waveshape data is DPCM-coded at a relatively small weighting rate, a waveshape with relatively fine waveshape change can be reproduced whereas if waveshape data is DPCM-coded at a relatively large weighting rate, a waveshape which follows a large waveshape change promptly is reproduced. By varying the weighting rate of each bit in the DPCM-coding, a coding form which is further suited to waveshape characteristics can be realized. Taking such difference in weighting into account, the DPCM code conversion section 6A is so constructed that it performs the code conversion operation using weighting rates which are predetermined for respective waveshapes. For this purpose, a DPCM shift data memory 8 stores different shift data corresponding to difference in weighting of waveshape data of respective DPCM-coded waveshapes and predetermined shift data SF is read out in response to the tone color selection information TC. This shift data SF is applied to the DPCM code conversion section 6A in which it is used for shifting waveshape data $W_0$ and thereby effecting the code conversion operation at a predetermined weighting rate.

Waveshape data MW of each sample point provided by the code conversion circuit 6 is applied to a multiplicator 9 where it is multiplied with an envelope shape signal supplied from an envelope generator 10. The envelope-controlled waveshape data is converted to an analog signal by a D/A converter 11 and thereafter is supplied to a sound system 12.

Figure 2:
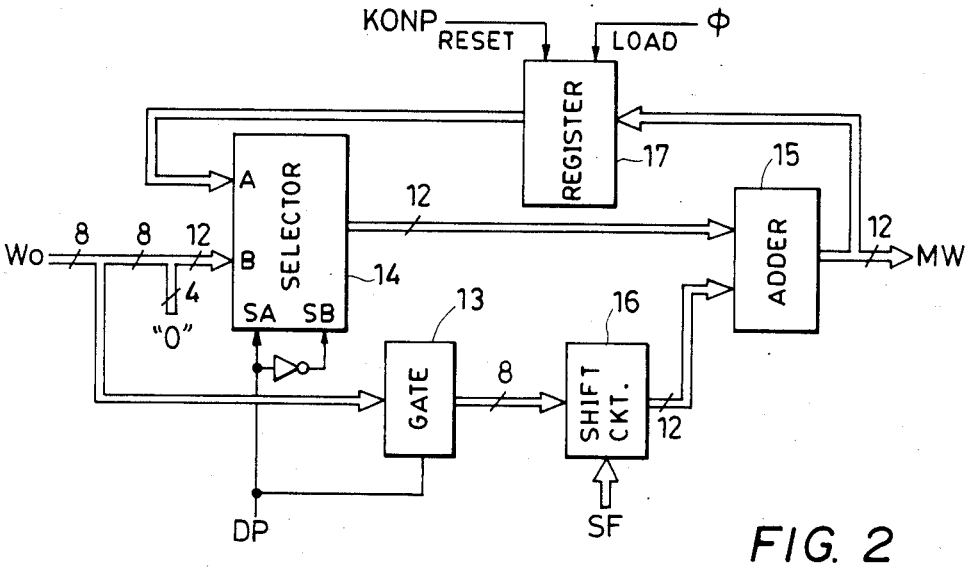
FIG. 2 is a block diagram showing a specific example of a code conversion circuit in FIG. 1.

A specific example of the code conversion circuit 6 will be described with reference to FIG. 2. Waveshape data $W_0$ read out from the waveshape memory 4 is assumed to be made of 8 bits with respect to both the PCM-coded data and the DPCM-coded data. It is also assumed that tone signal waveshape sample point amplitude data MW of the PCM system which is finally provided by the code conversion circuit 6 is made of 12 bits.

If the waveshape data $W_0$ read out from the waveshape memory 4 is coded according to the PCM system, the coding form indication data DP is "0" and, in this state, a gate 13 is closed and a selector 14 is in a B-input selection state. The B-input of the selector 14 has input lines of 12 bits, with input lines for the more significant 8 bits receiving the waveshape data $W_0$ of 8 bits and lines for the less significant 4 bits all receiving "0". Waveshape data of 12 bits generated from the selector 14 is directly provided as the tone signal waveshape sample point amplitude data MW via an adder 15. An output of a shift circuit 16 applied at this time at another input of the adder 15 is always "0" because the gate 13 is closed. Accordingly, the waveshape data $W_0$ of the PCM system is directly delivered out without being subjected to a particular code conversion operation.

If the waveshape data $W_0$ is coded according to the DPCM system, the coding form indication data DP is "1" and, in this state, the gate 13 is opened and the selector 14 is in an A-input selection state. To the A-input of the selector 14 is applied the output of the adder 15 via a register 17. The register 17 is reset at the beginning of depression of the key in response to the key-on pulse KONP and its contents of storage are renewed every one sampling time in response to a sampling clock pulse provided by the address generator 3 whose one period is equivalent to one sampling time. More specifically, result of addition in the adder 15 at a certain sampling time is loaded in the register 17 and outputted from this register 17 at a next sampling time. This output is applied to the adder 15 through the A-input of the selector 14. In the meanwhile, the waveshape data $W_0$ of 8 bits having been read out from the waveshape memory 4 is applied to the shift circuit 16 through the gate 13. The shift circuit 16 to which the shift data SF has been applied as described previously shifts the applied 8-bit waveshape data $W_0$ on any of the 12-bit output lines in response to the value of the shift data SF thereby applying a predetermined weighting to the DPCM-coded waveshape data $W_0$ Among the 12-bit output lines, those to which the 8-bit data has not been shifted become bit "0". The shift circuit 16 shifts, for example, the 8-bit DPCM waveshape data $W_0$ as shown in the following table 1 in response to values 0 to 3 of the shift data SF. The state of SF=0 corresponds to the minimum weighting and the state SF=3 corresponds to the maximum weighting.

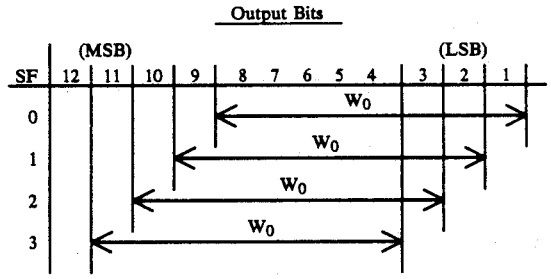

The waveshape data of the DPCM system thus shift-controlled in the shift circuit 16 is applied to the adder 15 and sequentially accumulated every sample point by an accumulator consisting of the loop of the adder 15, the register 17 and the selector 14. Since the waveshape data of the DPCM system is a difference value between amplitudes of adjacent sample points, the waveshape amplitude data MW of the PCM system at each sample point is derived by sequentially accumulating (including addition and subtraction) difference values with respect to each sample point.

Figure 3:
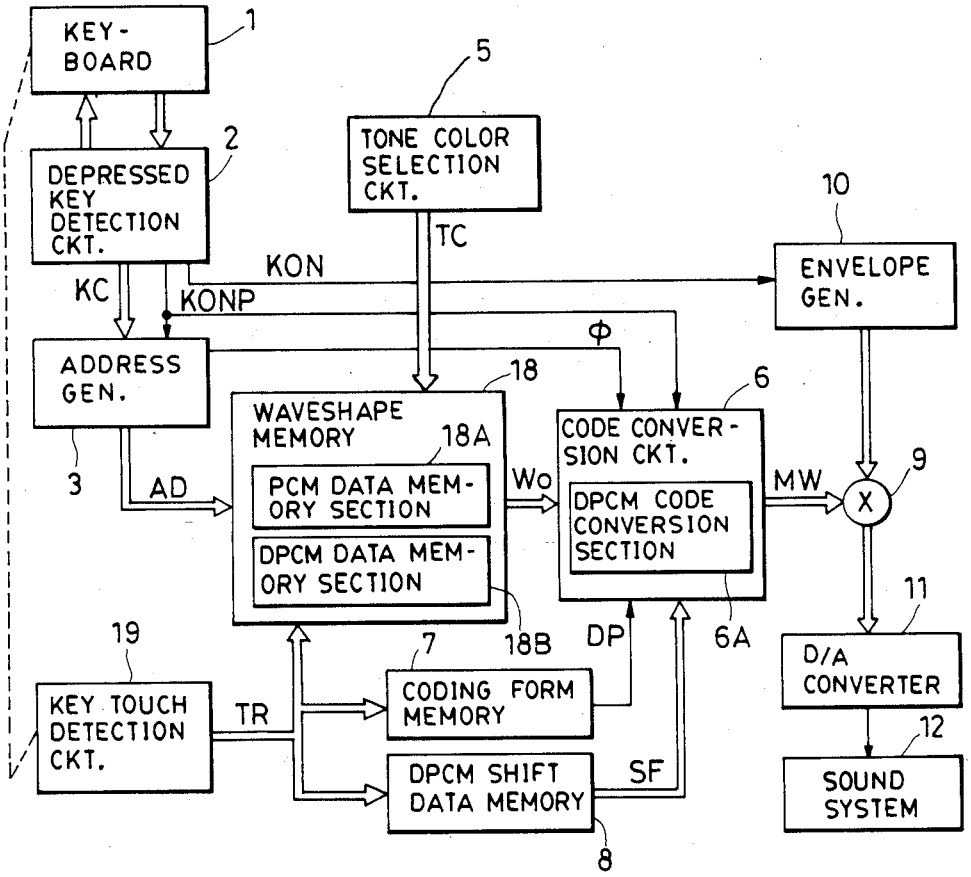
FIGS. 3 and 4 are block diagrams showing other embodiments of the invention.
Figure 4:
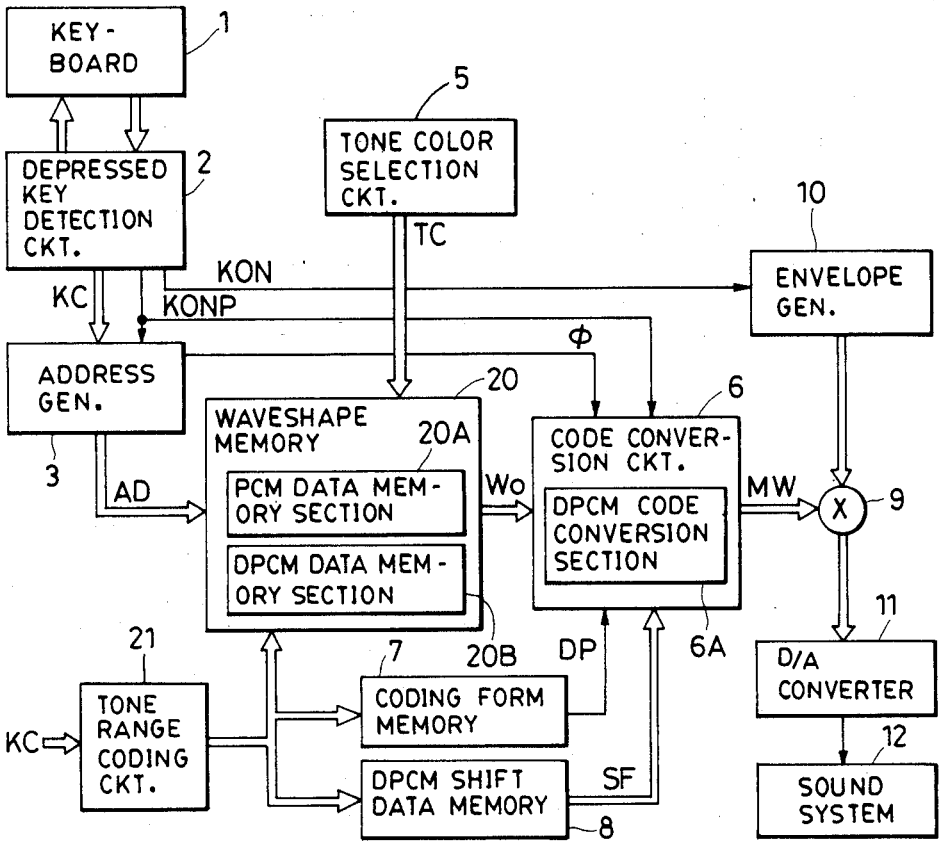

In the embodiment of FIG. 1, the waveshape memory 4 stores waveshapes corresponding to various tone colors and the coding form differs depending upon the tone color. The invention is not limited to this but it can be applied to a case in which several kinds of waveshapes are stored in a memory and these waveshapes are selectively read out. FIGS. 3 and 4 show these other embodiments of the invention.

In the embodiment shown in FIG. 3, plural waveshapes corresponding to several stages of key touch strength are stored in a waveshape memory 18 and at least one waveshape thereof is coded in a coding form different from one used for the other waveshapes. It is assumed that, as in the previously described embodiment, a waveshape is coded according to either the PCM system or the DPCM system and the waveshape memory 18 includes a PCM data memory section 18A and a DPCM data memory section 18B. In the same manner as in the previous embodiment, which of the two coding forms should be applied is determined by considering characteristics of the respective waveshapes. If, for example, the key touch strength is relatively strong, waveshape change is relatively sharp so that coding according to the PCM system which is suited to reproduction of such sharp waveshape change is preferable. Conversely, if the key touch strength is relatively weak, the waveshape change is not so sharp so that coding according to the DPCM system is preferable.

A key touch detection circuit 19 is provided in association with respective keys of the keyboard 1. The circuit 19 detects the key touch strength from depressing force applied to the depressed key or the depressing speed and outputs key touch data TR indicating levels of the key touch strength. This key touch data TR is applied, as the above-described tone color selection information TC, to the waveshape memory 18, the coding form memory 7 and the DPCM shift data memory 8 to select a waveshape to be read out from the waveshape memory 18 in response to the key touch strength, to read out data DP indicating the coding form of this waveshape from the memory 7 and also to read out shift data SF used for weighting in the code conversion from the memory 8 in the case where the coding form is the DPCM system.

In the embodiment shown in FIG. 4, plural waveshapes are stored in a waveshape memory 20 in correspondence to tone pitches of the respective keys (or tone ranges consisting of key groups each including plural keys) and at least one of the waveshapes is coded according to a coding form different from one used for the other waveshapes. In the same manner as described above, the coding form used is either the PCM system or the DPCM system and the waveshape memory 20 includes a PCM data memory section 20A and a DPCM data memory section 20B. In the same manner as described above, which coding form should be used is determined by considering characteristics of the respective waveshapes. Since, for example, a waveshape of a high tone range contains much harmonic content, the PCM system which is suited to reproduction of such waveshape is preferable. Conversely, a waveshape of a low tone range should preferably be coded according to the DPCM system.

If different waveshapes corresponding to tone pitches of the respective keys are stored in the waveshape memory 20, the key code KC representing the depressed key is directly applied to the waveshape memory 20, the coding form memory 7 and the DPCM shift data memory 8 in the same manner as for the tone color selection information TC. If different waveshapes corresponding to the respective tone ranges are stored in the waveshape memory 20, a tone range coding circuit 21 is provided as marked by a dotted line so that the key code KC is converted to a tone range code representing a tone range to which the key belongs and this tone range code is applied to the waveshape memory 20, the coding form memory 7 and the DPCM shift data memory 8. In this manner, the waveshape to be read out from the waveshape memory 20 is selected in accordance with the tone pitch or tone range of the depressed key and the data DP indicating the coding form of this waveshape is read out from the memory 7 and, if the coding form is the DPCM system, the shift data SF for weighting in the code conversion is read out from the memory 8.

In the waveshape memories 18 and 20 shown in FIGS. 3 and 4, different waveshapes as described above may be stored for respective tone colors. In this case, a tone color selection circuit 5 as marked for connection may be provided and the tone color selection information TC may be applied to the memories 18 and 20.

The coding form may also be determined by combination of any desired two or three factors of the tone color, key touch strength and tone pitch (or tone range). In this case, the waveshape to be read out from the waveshape memory is selected and the coding form memory 7 and the DPCM shift data memory 8 are accessed in accordance with a code representing the combination of these factors.

Instead of these three factors, other waveshape changing factor may be utilized for storing different waveshapes in the waveshape memory with at least one waveshape being coded according to a coding form different from one used for other waveshapes.

In the above described embodiments, the two coding forms of the PCM system and the DPCM system are employed. Other coding forms such as the delta modulation (DM) system, the adaptive delta modulation (ADM) system and the adaptive differential pulse code modulation (ADPCM) system may be adopted as desired depending upon the situation.

Since each of the above described various coding forms themselves is known, details of the respective coding forms are not described here. For those details, reference can be made, for example, to the book "Digital Processing of Speech Signals" written by Lawrence R. Rabiner and Ronald W. Schafer published by Prentice-Hall, Inc.

The invention is applicable not only to a device generating a scale tone as in the above described embodiments but to a device generating a rhythm sound. The PCM system is suitable for a waveshape such as cymbal which undergoes a complicated change whereas the DPCM system is suitable for a waveshape such as bass drums which undergoes little change.

One waveshape which is stored in the waveshape memory may be either of plural periods or of one period or half period. The advantage of the invention will however be more remarkable in a case where plural waveshapes each consisting of plural periods are stored. As to the method for storing a waveshape of plural periods, any desired method may be used from among various methods. Such methods include one in which an entire waveshape from start of sounding of a tone to the end thereof is stored and this waveshape is once read out, one in which a waveshape of plural periods in the entire attack portion and a waveshape of plural periods (or one period) of a part of the sustain portion are stored and the attack portion is read out once and thereafter the waveshape of the sustain portion is repeatedly read out and one in which waveshapes of intermittent periods are stored among which a waveshape of one period is read out repeatedly by a predetermined period number or time, this waveshape of one period to be read out being sequentially shifted. The address generator 3 is adapted to enable reading of such various waveshapes of plural periods.

In the above described embodiments, the waveshape memories 4, 18 and 20 are physically composed of a single memory device with its partial memory sections being assigned for storing respective waveshapes. The invention is not limited to this but includes a case in which different waveshapes are stored in physically separate memories.

In the embodiments shown in FIGS. 1 through 4, waveshapes which differ depending upon such factors as tone color, key touch and tone pitch are stored in the waveshape memories 4, 8 and 20 and different coding forms are used for different waveshapes. In embodiments to be described below with reference to FIGS. 5 through 8, different coding forms are used for waveshapes of respective sections in a tone generation duration from the start of sounding of the tone to the end thereof in accordance with characteristics of the respective sections, though these waveshapes are ones in the same tone.

Figure 6:
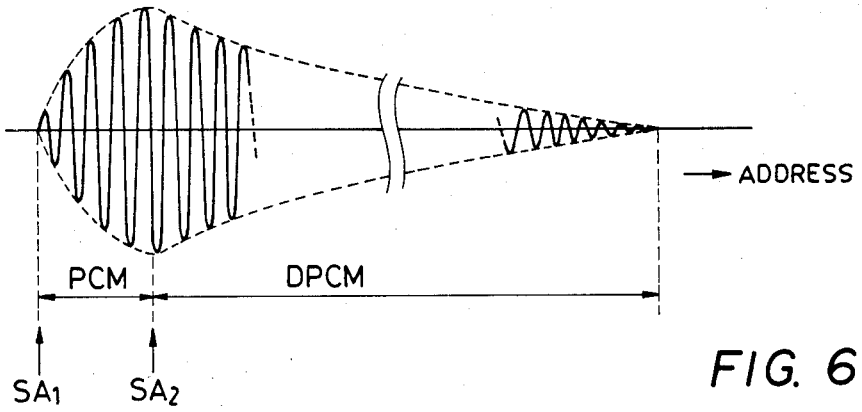
FIG. 6 is a diagram showing an example of difference in the coding form corresponding to sounding stages of a waveshape stored in the waveshape memory in FIG. 5.
Figure 5:
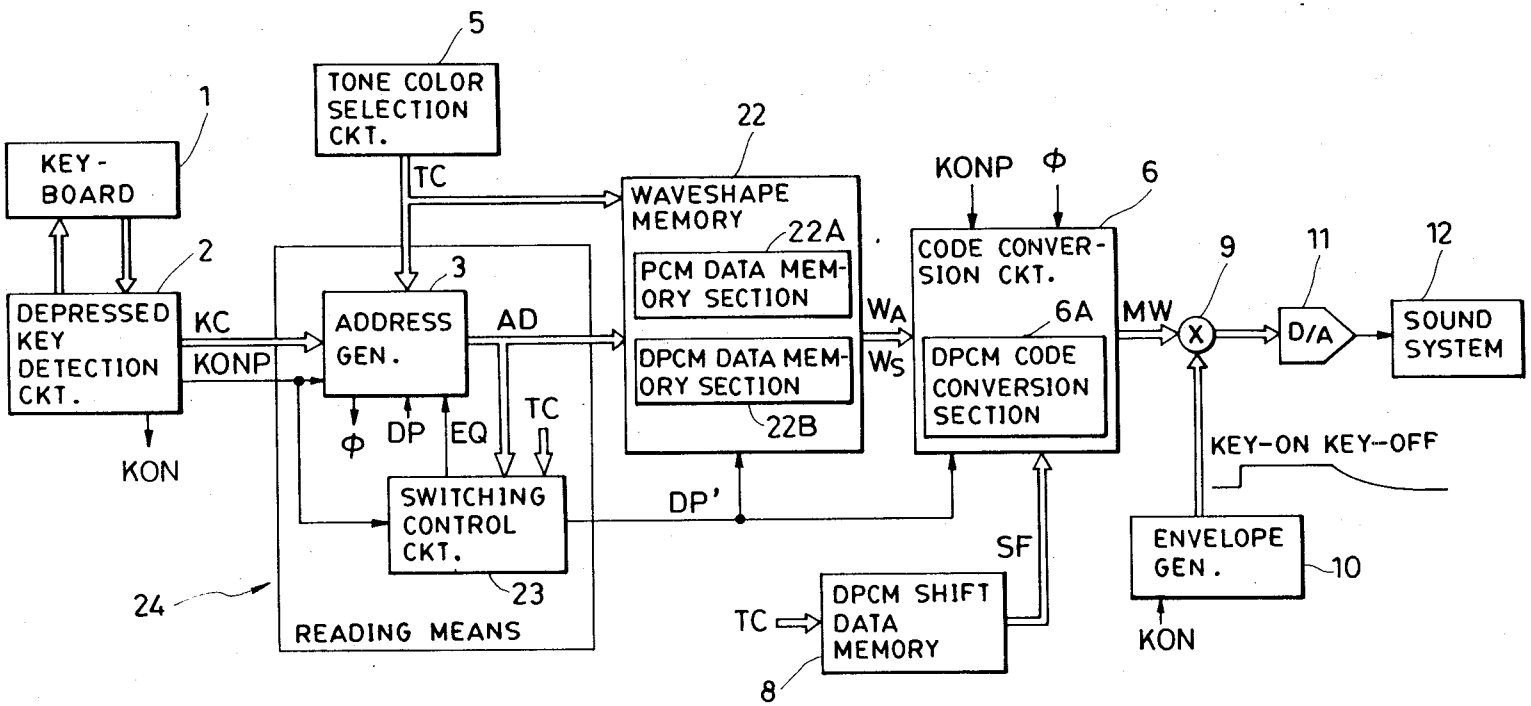
FIG. 5 is a block diagram showing an entire construction of still another embodiment of a tone generation device according to the invention.

In FIG. 5, a waveshape memory 22 stores data of the entire waveshape from the start of sounding of the tone to the end thereof with respect to each tone color which can be selected by a tone color selection circuit 5. An example of the waveshape stored in the memory 22 is shown in FIG. 6. This waveshape has an envelope of a percussive sound. Different coding forms are applied to the rise portion (attack) and the subsequent portion (sustain) in the waveshape stored in the memory 22. The waveshape of entire periods in the attack portion is coded according to the PCM system and the waveshape of entire periods in the sustain portion is coded according to the DPCM system. In a musical tone, a waveshape of an attack portion contains much noise and harmonic content and tends to undergo a sharp change whereas a sustain portion has a relatively stable waveshape. Accordingly, the PCM system which follows the waveshape change promptly is used for coding the waveshape of the attack portion and the DPCM system which is capable of reducing the bit number of data is used for the sustain portion which need not follow the waveshape change so promptly. The waveshape memory 22 comprises a PCM data memory section 22A storing data of waveshape of the attack portion coded according to the PCM system and a DPCM data memory section 22B storing data of waveshape of the sustain portion coded according to the DPCM system.

An address generator 3 and a switching control circuit 23 constitute reading means 24 which functions to switch timewise a waveshape to be read out and reads out a waveshape determined by this switching from the waveshape memory 22. The switching control circuit 23 starts the waveshape switching control in response to the key-on pulse KONP and performs the switching control, judging timing for switching the waveshape in accordance with contents of an address signal AD provided by the address generator 3. Data DP' identifying a waveshape to be read out (since in this embodiment the entire tone generation period is divided into two time sections and different coding forms are applied to the two time sections, the data DP' identifying the waveshape corresponds to data identifying the coding forms, i.e., coding form indication data DP) is provided by the switching control circuit 23 and supplied to the address generator 3, the waveshape memory 22 and a code conversion circuit 6. When this data DP' is "0", it indicates the waveshape of the attack portion, i.e., the PCM system and when it is "1", it indicates the waveshape of the sustain portion, i.e., the PDCM system. Therefore, when this data DP' is "0", the PCM data memory section 22A in the waveshape memory 22 is in an accessible state whereas when the data DP' is "1", the DPCM data memory section 22B is in an accessible state.

A specific example of the reading means 24 will be described with reference to FIG. 7. The address generator 3 comprises a note clock generation circuit 25 which generates a note clock pulse having a frequency corresponding to the tone pitch of a key designated by the key code KC and a counter 26 counting this note clock pulse. The switching control circuit 23 comprises a flip-flop 27 for setting data DP'. A PCM end address detection circuit 28 comprises a memory section storing data indicating the end address of the waveshape of the attack portion coded according to the PCM system with respect to each tone color. The circuit 28 reads out the end address data in response to the tone color selection information TC provided by the tone color selection circuit 5 (FIG. 5), compares this data with the address signal AD and turns a coincidence signal EQ' to "1" when the two signals coincide with each other. This coincidence signal EQ is applied to a set input S of the flip-flop 27 and also to a reset input R of the counter 26 through an OR gate 29. Likewise, a DPCM end address detection circuit 30 comprises a memory section storing the end address of the waveshape of the sustain portion coded according to the DPCM system with respect to each tone color. The circuit 30 reads out the end address data in response to the tone color selection information TC, compares this data with the address signal AD and turns a coincidence signal EQ' to "1" when the two signals coincide with each other. This coincidence signal EQ' is inverted by an inverter 31 and thereafter is applied to a gate 32. The gate 32 performs a control for supplying the note clock pulse generated by the note clock generation circuit 25 to a count input C of the counter 26.

A start address memory 33 stores, with respect to each tone color, data indicating the first address of the waveshape of the attack portion coded according to the PCM system (start address $SA_1$) and data indicating the first address of the waveshape of the sustain portion coded according to the DPCM system (start address $SA_2$). Two start address data corresponding to a certain tone color become readable in response to the tone color selection information TC and when the data DP' supplied from the flip-flop 27 is "0", the data of the start address $SA_1$ for the attack portion is read out whereas when the data DP' is "1", the data of the start address $SA_2$ of the sustain portion is read out. The read out address data are applied to an adder 34 and added to the count output of the counter 26. The output of the adder 34 is applied as the address signal AD to the waveshape memory 22 and also to the PCM end address detection circuit 28 and the DPCM end address detection circuit 30. The key-on pulse KONP provided by the depressed key detection circuit 2 is applied to the reset input R of the flip-flop 27 and also to the reset input R of the counter 26 through the OR gate 29.

First, upon generation of the key-on pulse KONP at the beginning of sounding of the tone, the flip-flop 27 and the counter 26 are reset. The output of the flip-flop 27, i.e., the data DP' becomes "0" indicating at first the waveshape of the attack portion, i.e., the waveshape coded according to the PCM system. By this "0" state of the data DP', the start address data of the attack portion is read out from a start address memory 33. Since at first the output of the counter 26 is "0", this start address data is produced directly by the adder 34 and constitutes the address signal AD. The DPCM end address detection circuit 30 turns the coincidence signal EQ' to "0" by application of the start address data thereto thereby opening the gate 32. This causes the note clock pulse to be applied to the counter 26 which in turn increases its count at a rate corresponding to the tone pitch of the tone to be generated. The start address data is added to this count output so that the address signal AD increasing gradually from the start address of the attack portion is derived from the adder 34. Accordingly, PCM data $W_A$ at each sample point of the waveshape of the attack portion is sequentially read out from the PCM data memory section 22A of the waveshape memory 22.

Upon reaching of the end address of the waveshape of the attack portion, reading of this waveshape of the attack portion is completed and reading of the waveshape of the sustain portion is started. More specifically, upon reaching of the value of the address signal AD to the end address of the attack portion, the coincidence signal EQ' of the PCM end address detection circuit 28 becomes "1" and the flip-flop 27 thereby is set and the counter 26 is reset. By the setting of the flip-flop 27, the data DP' is turned to "1" so that the start address data of the sustain portion is read out from the start address memory 33. Since at first the output of the counter 26 is "0", the start address data is directly used as the address signal AD and subsequently the address signal AD increases in accordance with increase in the count value. Thus, DPCM data $W_S$ at each sample point of the waveshape of the sustain portion is sequentially read out. As the reading reaches the end address of the sustain portion, the coincidence signal EQ' of the DPCM end address detection circuit 30 is turned to "1" and the gate 32 thereby is closed and the counter 26 stops its counting operation.

In FIG. 5, the waveshape data $W_A$ of the PCM system and the waveshape data $W_S$ of the DPCM system successively read out from the waveshape memory 22 are applied to the code conversion circuit 6 in which these data are converted to a predetermined common coding form in accordance with the coding form thereof. By way of example, the PCM system is employed as the predetermined common coding form. In the code conversion circuit 6, therefore, the waveshape data $W_A$ which has originally been coded in the PCM system is not converted in its coding form whereas the waveshape data $W_S$ which has been coded according to the DPCM system is converted to data of the PCM system. For converting the data of the DPCM system to data of the PCM system, the code conversion circuit 6 includes a DPCM code conversion section 6A.

The data DP' indicating the coding form provided by the switching control circuit 23 is applied to the code conversion circuit 6 to indicate contents of the code conversion operation in the circuit 6. When the data DP' is "0", no particular code conversion operation is performed but the waveshape data $W_A$ of the PCM system is directly produced whereas when the data DP' is "1", it indicates the code conversion operation so that the waveshape data $W_S$ of the DPCM system is converted to data of the PCM system.

In this embodiment, in the same manner as in the embodiment of FIG. 1, weighting of data of each bit is made different depending upon the tone color though the waveshape data is coded according to the same DPCM system. For this purpose, in the same manner as in FIG. 1, predetermined shift data SF is read out from a DPCM shift data memory 8 in response to the tone color selection information TC. This shift data SF is applied to the DPCM code conversion section 6A to shift the waveshape data $W_S$ so that the code conversion operation is effected with a predetermined weighting.

Waveshape data MW at each sample point provided by the code conversion circuit 6 is applied to a multiplier 9 as in the embodiment of FIG. 1 in which it is multiplied with an envelope shape signal from an envelope generator 10. The envelope-controlled waveshape data is converted to an analog signal by a D/A converter 11 and thereafter is supplied to a sound system 12. The envelope shape signal is one which, as shown in the figure, maintains a constant level while the key is being depressed and exhibits decay characteristics upon releasing of the key. This is because the envelope of a percussive sound is assumed to have been imparted to the waveshape stored in the waveshape memory 22.

Figure 8:
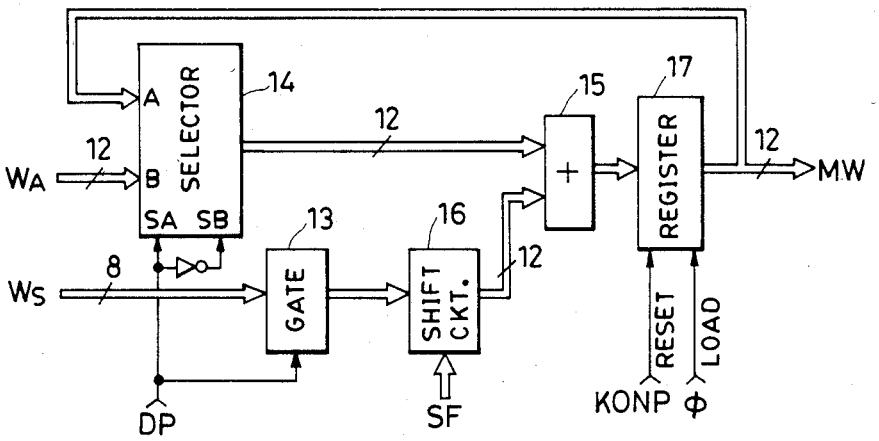
FIG. 8 is a block diagram showing a specific example of a code conversion circuit in FIG. 5.

FIG. 8 shows a specific example of the code conversion circuit 6 shown in FIG. 5. The code conversion circuit 6 consists of a circuit closely similar to the one shown in FIG. 2. It is assumed that the waveshape data read out from the waveshape memory 22 consists of the PCM coded data $W_A$ of 12 bits and the DPCM coded data $W_S$ of 8 bits. It is also assumed that the tone waveshape sample point amplitude data MW of the PCM system which is finally produced by the code conversion circuit 6 is 12-bit data.

When the waveshape data $W_A$ coded according to the PCM system has been read out from the waveshape memory 22, the data DP' is "0" and the gate 13 is closed and the selector 14 is in a B-input selection state. The B-input of the selector 14 has input lines of 12 bits and receive the PCM coded waveshape data $W_A$ of 12 bits. The waveshape data of 12 bits provided from the selector 14 is directly outputted as the tone waveshape sample point amplitude data MW through an adder 15 and a register 17. In this manner, the waveshape data $W_A$ of the PCM system is directly outputted without being subjected to the code conversion operation.

When the waveshape data $W_S$ which has been coded according to the DPCM system has been read out, the data DP' is "1". The gate 13 is opened and the selector 14 is in an A-input selection state and a similar operation to that in FIG. 2 is performed.

In the above described embodiment, the waveshape data of the PCM system has a different number of bit for one sample point from the waveshape data of the DPCM system and they are stored in the different memory sections 22A and 22B. Alternatively, the same bit number for one sample point may be used for these two waveshape data and the two waveshape data may be stored in continuous address areas in the same memory. In this case, the processing of switching the reading address by means of the data DP' and the coincidence signal EQ is not necessary but the waveshape to be read out can be switched automatically from the one of the attack portion to the one of the sustain portion simply by continuously increasing the address signal AD.

Figure 7:
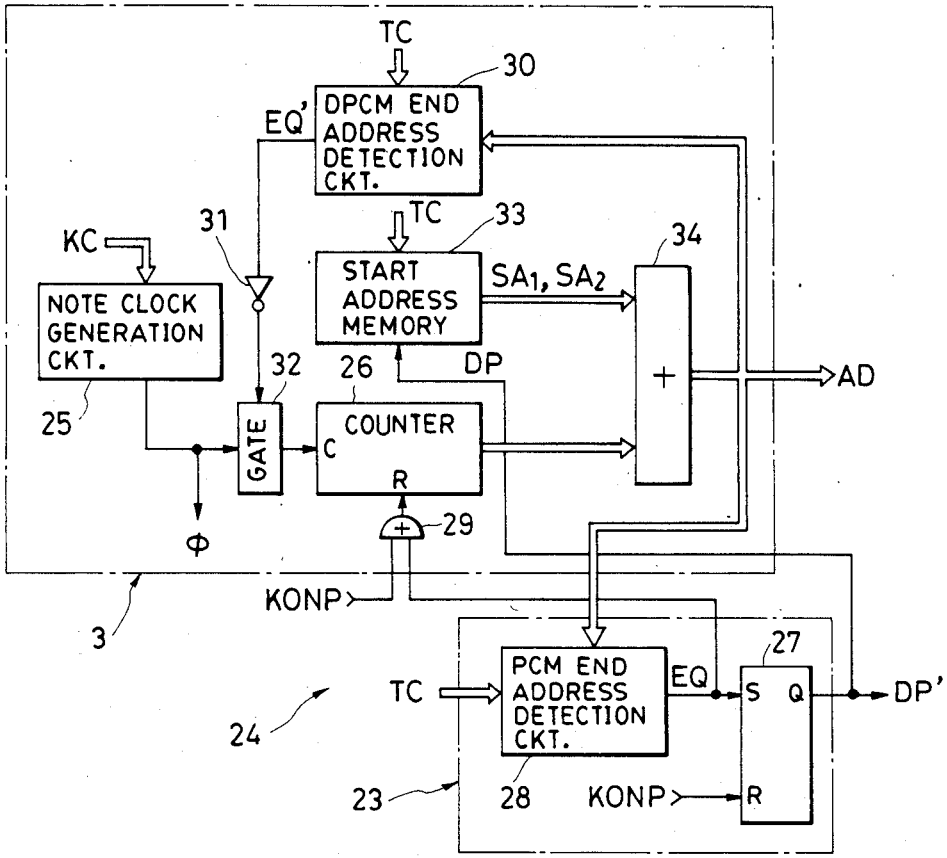
FIG. 7 is a block diagram showing a specific example of reading means in FIG. 5.

In FIG. 7, the waveshape to be read out is designated by designating the start address signal in the address generator 3. The tone color selection information TC and the data DP may be applied to the waveshape memory 22 as a waveshape designating signal and a waveshape determined by this waveshape designation signal may be read out in response to the address signal AD.

In the embodiment of FIG. 5, the waveshape of the entire tone generation periods of the sustain portion is stored in the memory according to the DPCM system. Alternatively, waveshape of one period or partial plural periods may be stored and this waveshape may be repeatedly read out. By doing so, not only a tone signal having a percussive sound envelope but also a tone signal having a sustain sound envelope can be generated.

In the embodiment of FIG. 5, the tone generation period is divided into two portions, i.e., the attack portion and all of the subsequent portion. The division of time section is not limited to this but any desired division may be adopted. For example, the attack portion may be divided into plural sections and different coding forms may be used for these different sections or a waveshape of a part of the attack portion may be stored and read out repeatedly. The sustain portion may be divided into plural partial sections (each partial section may be continuous or intermittent and the frequency of one period of waveshape may be one period or plural periods or half period). In this case, the coding form of each partial period may be a common one or different ones. Alternatively, a waveshape of intermittent plural periods may be stored and a waveshape of one period thereof may be repeatedly read out by a predetermined number of periods or time with this one period waveshape being sequentially switched one waveshape after another. The address generator should be modified suitably to enable reading of such various waveshapes.

In the embodiment of FIG. 5 also, the coding forms to be used are not limited to the PCM and DPCM systems but other coding forms such as the delta modulation (DM) system, the adaptive delta modulation system (ADM) system and the adaptive differential pulse code modulation (ADPCM) system may be adopted as desired.

A memory system similar to the one shown in FIG. 5 may be used not only for a device generating a musical scale tone but also to a device generating a rhythm sound.

In the embodiment of FIG. 5, the waveshape memory 22 is physically composed of a single memory device with its partial memory sections being assigned for storing respective waveshapes. The invention is not limited to this but includes a case in which different waveshapes are stored in physically separate memories.

What is claimed is:

1. A tone signal generation device comprising:

waveshape memory means storing a plurality of different waveshapes among which at least one waveshape is coded according to a coding system which is different from one used for the other waveshapes;

waveshape selection means for selecting a waveshape of a tone to be generated from among the waveshapes stored in said waveshape memory means;

reading means for reading out data of the selected waveshape selected by said waveshape selection means from said waveshape memory means; and code conversion means for converting the data of the read out waveshape to data of a predetermined common coding system when the read out waveshape data is coded according to a coding system which is different from the predetermined common coding system.

2. A tone signal generation device as defined in claim 1 wherein respective waveshapes stored in said waveshape memory means include a waveshape of plural periods.

3. A tone signal generation device as defined in claim 1 wherein respective waveshapes stored in said waveshape memory means correspond to one of plural kinds of tone colors and said waveshape selection means includes a tone color selection means.

4. A tone signal generation device as defined in claim 1 wherein respective waveshapes stored in said waveshape memory means correspond to one of plural levels of key touch strength and said waveshape selection means selects a waveshape in response to the strength of key touch applied to a key for designating the tone pitch of the tone to be generated.

5. A tone signal generation device as defined in claim 1 wherein respective waveshapes stored in said waveshape memory means correspond to one of tone pitches or tone ranges of the tone to be generated and said waveshape selection means selects a waveshape in response to the tone pitch or tone range of the tone to be generated.

6. A tone signal generation device as defined in claim 1 wherein respective waveshapes stored in said waveshape memory means is coded according to a coding system among plural coding systems which is suited to characteristics of each individual waveshape.

7. A tone signal generation device as defined in claim 1 wherein the waveshapes stored in said waveshape memory means include waveshapes which are coded according to the differential pulse code modulation system, weighting of data bit of these differential-pulse-code-modulated waveshapes differing between the respective differential-pulse-code-modulated waveshapes; and said code conversion means changes data of the differential-pulse-code-modulated waveshapes to data of a common weighting by shifting the data of the differential-pulse-code-modulated waveshapes in accordance with the difference in the weighting and converts the differential-pulse-code-modulated waveshapes which have thus been changed in weighting to data of the pulse code modulation system.

8. A tone signal generation device as defined in claim 1 wherein the code conversion means includes:

register means for storing a previously generated data of the common coding system, and adder means for adding the previously generated data stored in the register means to a newly supplied coded data that is supplied from the reading means.

9. A tone signal generation device as defined in claim 8 wherein the code conversion means includes shifting means, coupled to the adder means, for shifting the newly supplied coded data by a preselected number of bit positions before the newly supplied coded data is added to the previously generated data.

10. A tone signal generation device as defined in claim 1 wherein the different coding systems are pulse code modulation (PCM) and differential pulse code modulation (DPM).

11. A tone signal generation device comprising:

waveshape memory means storing data of plural waveshapes each corresponding to respective time sections of an entire tone generation duration from the start of sounding of a tone to the end thereof, wherein at least one waveshape is coded according to a coding system which is different from one used for other waveshapes;

reading means for timewise switching a waveshape to be read out and for reading out from said waveshape memory means data of a waveshape determined by said switching; and code conversion means for converting the data of the read out waveshape to data of a predetermined common coding system when the read out waveshape data is coded in accordance with a system which is different from the predetermined common coding system.

12. A tone signal generation device as defined in claim 11 wherein said reading means comprises means for providing information identifying the coding system of the waveshape being currently read out and said code conversion means performs the code conversion control in accordance with said identifying information.

13. A tone signal generation device as defined in claim 11 wherein respective waveshapes stored in said waveshape memory means comprise a waveshape of plural periods of an attack portion of the tone generation duration and a waveshape of a subsequent portion of the tone generation duration, the waveshape of the attack portion is coded according to a pulse code modulation system and the waveshape of the subsequent portion is coded according to a coding system which is different from the pulse code modulation system; and said code conversion means converts the data of the waveshape coded according to a coding system which is different from the pulse code modulation system to data of the pulse code modulation system.

14. An electronic musical instrument comprising:

keys for designating tone pitches of tones to be generated;

depressed key detection means for detecting one or more depressed keys;

waveshape memory means for storing coded data representing different waveshapes among which at least one waveshape is coded according to a first coding system which is different from a second coding system used for coding a second of the waveshapes;

waveshape selection means for selecting a waveshape of a tone signal to be generated from among the coded waveshapes stored in said waveshape memory means in accordance with the tone pitch of the key detected by said depressed key detection means;

reading means for reading out the coded data of the selected waveshape from said waveshape memory means;

code conversion means for converting the coded data of the read out waveshape to data of a predetermined common coding system in accordance with the coding system of the read out waveshape data;

digital-to-analog conversion means for converting the commonly coded waveshape data from said code conversion means to an analog signal; and a sound system for sounding a tone in response to the analog signal from said digital-to-analog conversion means.

15. A tone signal generation device comprising:

waveshape memory means for storing a plurality of different digitally coded waveshapes, wherein at least a first waveshape is coded according to a first coding system and at least a second waveshape is coded according to a second coding system different from the first coding system;

waveshape selection means for selecting a waveshape of a tone to be generated from among the waveshapes stored in the waveshape memory means;

reading means for reading out data of the selected waveshape from the waveshape memory means;

code conversion means for converting the data of the read out waveshape to data of the first coding system whenever the read out data is coded according to a system other than the first coding system so as to provide waveshape data coded according to the first coding system and corresponding to the read out waveshape; and decoding means for (a) receiving waveshape data read out from the waveshape memory means when the read out waveshape is coded according to the first coding system and receiving converted waveshape data from the code conversion means when the read out waveshape is coded according to a system other than the first coding system, and (b) decoding the received data to form analog tone signals.

16. A device as in claim 15 wherein the first coding system is pulse code modulation (PCM) and the second coding system is differential pulse code modulation (DPCM).

17. A tone signal generation device comprising:

waveshape memory means storing a plurality of waveshapes among which at least two waveshapes are digitally represented by coded data that is coded according to different coding forms, the different coding forms being characterized as requiring substantially different decoding means for reproducing the waveshapes;

waveshapes selection means for selecting a tone waveshape to be generated from among the waveshapes stored in said waveshape memory means;

reading means for reading out the coded data of the selected tone waveshape from said waveshape memory means; and code conversion means for converting the coded data of the read out tone waveshape to data of a predetermined common coding form, which is decodable by a preselected decoding means, when the coding form of the coded data is not the same as the predetermined common coding form.

18. A tone signal generation device as defined in claim 17 wherein respective ones of the waveshapes stored in said waveshape memory means belong to a tone having a continuous waveshape of plural periods, the periods of the continuous waveshape are characterized by either a relatively high or relatively low rate of waveshape change, and differently characterized ones of the periods are represented in the waveshape memory means by respective data coded according to different coding forms.

* * * * *